US005082422A

United States Patent [19]

Wang

[11] Patent Number: 5,082,422

[45] Date of Patent: Jan. 21, 1992

[54] ILLUMINATIVE FAN

[76] Inventor: Sui-Mu Wang, c/o Hung Hsing Patent Service Center, P.O. Box 55-1670, Taipei (10477), Taiwan

[21] Appl. No.: 712,502

[22] Filed: Jun. 10, 1991

[51] Int. Cl.[5] ..... F21V 33/00

[52] U.S. Cl. ..... 416/5; 362/96; 362/234

[58] Field of Search ..... 416/5.62; 362/96, 234

[56] References Cited

U.S. PATENT DOCUMENTS 3,174,552 3/1962 Soucy, Jr. ..... 416/5
3,701,498 10/1972 Ferrara ..... 416/5
3,723,722 3/1973 Van Iderstine et al. ..... 416/5
4,342,073 7/1982 Ranten ..... 416/5
5,028,206 7/1991 Kendregan ..... 416/5

*Primary Examiner*—John T. Kwon

[57] ABSTRACT

An illuminative fan includes a plurality of illuminators selected from light-emitting diodes juxtapositionally interlacedly disposed on each fan blade capable of being flashed or colored so that upon a rotation of the fan, the illuminators will produce diversified optical or colorful figures on the rotating blades due to persistence of human vision either flashingly or continuously for enriching a decorative effect for the illuminative fan.

1 Claim, 3 Drawing Sheets

ILLUMINATIVE FAN

BACKGROUND OF THE INVENTION

A conventional ceiling fan may be provided with a decorative lamp on a central portion of the fan for optical decorative and illuminating purpose besides its air-blowing cooling effect. However, the lamp mounted on a central portion of the fan is a fixed type which is rotated at the central portion of the fan along with the rotation of the fan blades, unable to produce diversified color and figure changes for enriching a decorative function of the ceiling fan mounted with a lamp.

It is therefore expected to disclose a fan having a plurality of illuminators mounted on the fan blades for producing diversified color and figure changes when the fan blades are rotated.

SUMMARY OF THE INVENTION

The object of the present invention is to provide an illuminative fan having a plurality of illuminators selected from light-emitting diodes juxtapositionally interlacedly disposed on each fan blade capable of being flashed or coloured so that upon a rotation of the fan, the illuminators will produce diversified optical or colorful figures on the rotating blades due to persistence of human vision either flashingly or continuously for enriching a decorative effect for the illuminative fan.

DETAILED DESCRIPTION

Figure 1:
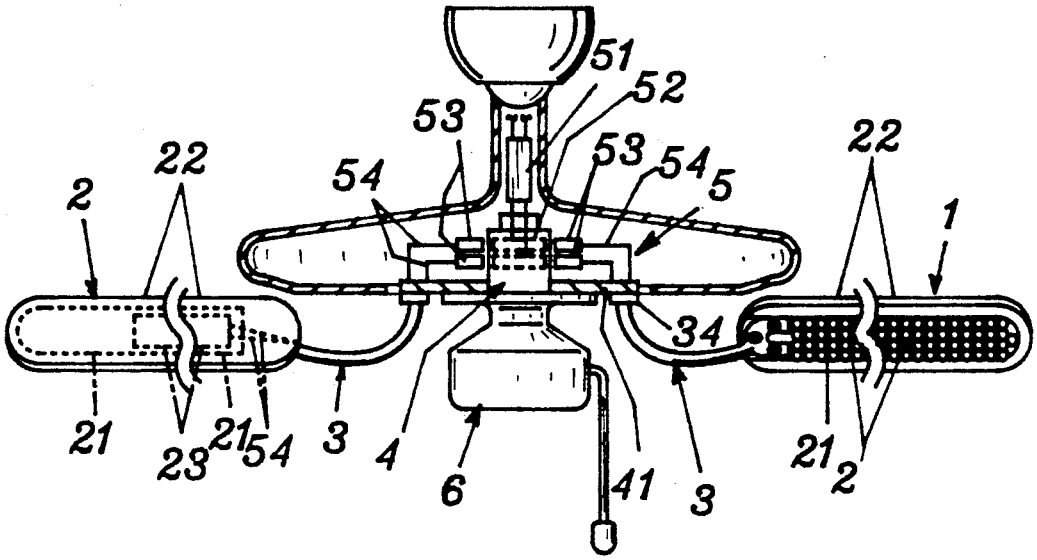
FIG. 1 is an illustration of the present invention serving as a ceiling fan.
Figure 3:
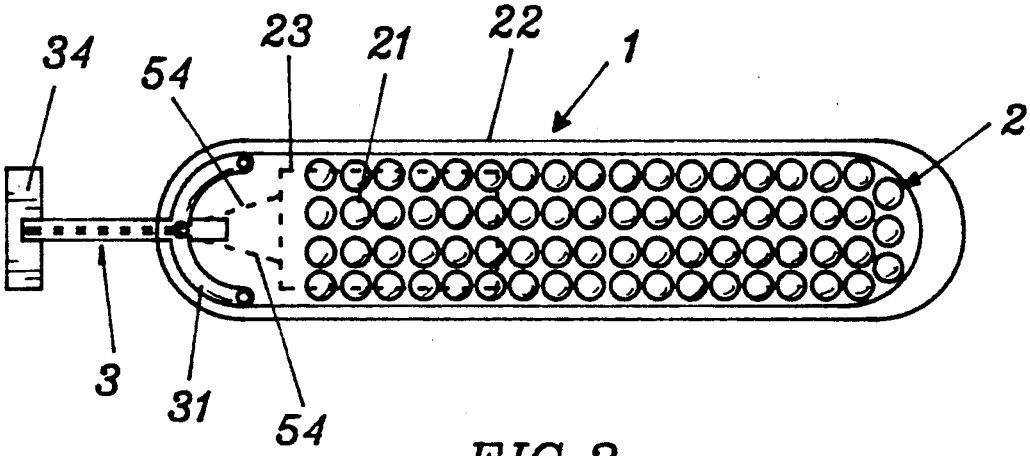
FIG. 3 is a plan view of the present invention.

As shown in the figures, the present invention comprises: a plurality of fan blades 1 radially secured on a central disk 41 of a driving motor 4 of the fan, each blade 1 having an illuminator board 2 mounted thereon and secured to the disk 41 by a fixing arm member 3, and a power supply means 5 electrically connected to each illuminator board 2.

Figure 2:
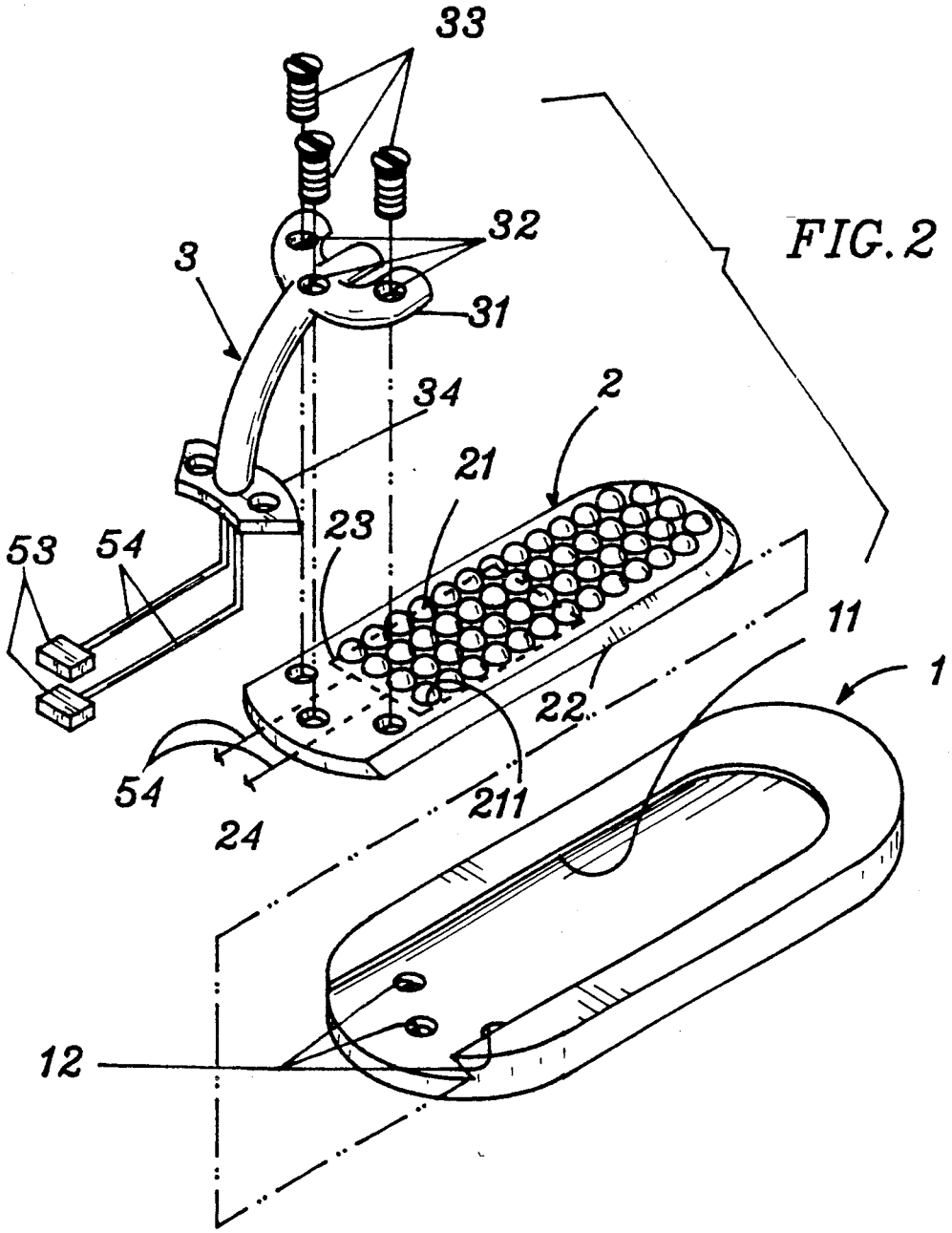
FIG. 2 is an exploded view of the present invention.

Each fan blade 1 includes: a shallow recess 11 recessed in the blade 1 for mounting the illuminator board 2 therein, and a plurality of fixing holes 12 formed through the blade 1 for combinably fixing the blade 1, the board 2 to the fixing arm member 3 by screws 33 as shown in FIG. 2.

Each illuminator board 2 includes: a plurality of illuminators 1 preferably selected from light-emitting diodes (LED) fixed in a plurality of sockets 211 formed as a matrix array having a plurality of columns and a plurality of rows juxtapositionally interlacedly disposed on a substrate board 22 engageable with the shallow recess 11 of the blade 1, an illuminating controller 23 formed as an integrated circuit secured on a printed circuit board fixed in the substrate board 22, and a plurality of fixing holes 24 formed in the board 22 to be secured with the blade 1 and the arm member 3.

Each fixing arm member 3 includes: an outer bracket 31 having a plurality of fixing holes 32 formed therein for securing the board 2, and the fan blade 1 by screws 33, and an inner bracket 34 secured to the central disk 41 secured to a motor shaft of the driving motor 4 which is driven by a power source (not shown) for rotating the blades 1 for air-cooling purpose.

The power supply means 5 includes: a transforming and rectifying adapter 51 connected to a power source of alternative current, a pair of electrical conductive ferrules 52 electrically connected with two poles of the adapter 51 of power source circumferentially disposed around a motor casing of the driving motor 4 as shown in FIG. 1, a pair of carbon brushes 53 respectively slidably contacting the two electrical conductive ferrules 52, and two wires 54 respectively connected to the two carbon brushes 53 for electrically connecting the illuminating controller 23 for powering the controller 23 and the illuminators 21.

The illuminators 21 are perferably selected from light-emitting diodes (LED) and may be formed with multiple colors in the matrix array arrangement on the substrate board 22, and may of course be formed with a single color.

The illuminating controller 23 may be an integrated circuit, a flashing driver or other controlling devices, which are not limited in this invention.

Figure 4:
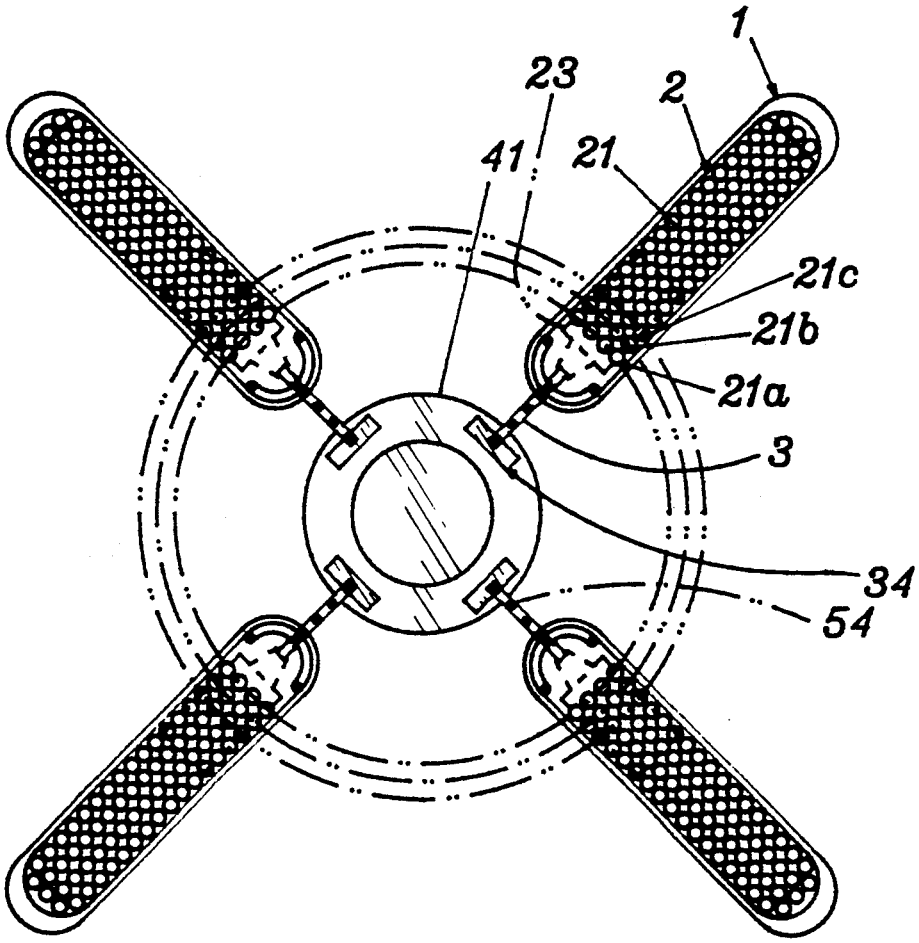
FIG. 4 is an illustration showing a rotating fan in accordance with the present invention.

As shown in FIG. 4, the plurality of illuminators or LEDs 21 may be formed with a plurality of annular rows of different colored illuminators 21 concentric to an axis of the motor 4, such as 21*a*, 21*b*, 21*c* - - - and so on, each row provided with a specific color, so that upon a rotation of the fan blades 1, a plurality of different "optical color rings" will be annularly formed for a brilliant colorful decorative purpose. In such an embodiment, the controller 23 may be eliminated since all the illuminators or LEDs 21 may be lit.

The present invention may be modified to form diversified color and figure changes by controlling a random lighting or selective lighting of any specific individual or group of illuminators 21.

The fan may be a ceiling fan or any other fans, powered by AC or DC current, being not limited in this invention.

The controller 23 may also be designed by incorporating a rotating speed control for the fan rotation and a time sequence lighting control in commensuration with an address lighting control for the illuminators 21 so that the rotating blades with the illuminating LEDs 21 will serve as an effective display for commercial advertisement purposes.

Therefore, the present invention can be provided for increasing its diversified illuminative decorative effect, superior to a conventional fan, such as a ceiling fan secured with a lamp thereon.

I claim:

1. An illuminative fan comprising:

a plurality of fan blades radially secured to a motor shaft of a driving motor rotatably driven by said driving motor; each said fan blade having a plurality of illuminators mounted in said blade electrically connected to a power supply means and operatively lit by said power supply means, whereby upon a rotation of said fan blades, said illuminators once being lit will be rotated for producing decorative illuminating effect for the fan;

each said fan blade mounted with an illuminator board thereon, said illuminator board including said plurality of illuminators fixed in a plurality of sockets formed as a matrix array having a plurality of columns and rows juxtapositionally interlacedly disposed on a substrate board engageably fixed in a shallow recess of the fan blade, and an illuminating controller electrically connected with the power supply means for controlling the lighting of the illuminators.

* * * * *